US006520604B1

(12) United States Patent
Yasaka et al.

(10) Patent No.: US 6,520,604 B1
(45) Date of Patent: Feb. 18, 2003

(54) PRODUCT HOUSING APPARATUS AND PRODUCT HOUSING METHOD FOR VENDING MACHINE

(75) Inventors: Yoshio Yasaka, Gunma-ken (JP); Hidekazu Yajima, Saitama-ken (JP); Masaki Nakayama, Saitama-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 55 days.

(21) Appl. No.: 09/705,937

(22) Filed: Nov. 6, 2000

(51) Int. Cl.[7] ..... A47F 1/00
(52) U.S. Cl. ..... 312/61; 312/71
(58) Field of Search ..... 312/35, 42, 43, 312/45, 60, 61, 71, 72, 73; 211/59.2, 59.3; 221/1, 92

(56) References Cited

U.S. PATENT DOCUMENTS

| | | | | |
|---|---|---|---|---|
| 3,591,045 A | | 7/1971 | Sturrock et al. | |
| 3,831,807 A | * | 8/1974 | Deaton et al. | 312/35 X |
| 4,757,915 A | | 7/1988 | Albright et al. | |
| 4,942,980 A | | 7/1990 | Hellermann et al. | |
| 5,050,748 A | * | 9/1991 | Taub | 312/42 X |
| 5,111,942 A | * | 5/1992 | Bernardin | 312/61 X |
| 5,353,939 A | * | 10/1994 | Beeler et al. | 312/61 X |

FOREIGN PATENT DOCUMENTS

| | | | |
|---|---|---|---|
| DE | 3223804 | 3/1984 | |
| FR | 2617385 | * | 1/1989 |

* cited by examiner

*Primary Examiner*—James O. Hansen
(74) *Attorney, Agent, or Firm*—McDermott, Will & Emery

(57) ABSTRACT

A product housing apparatus for a vending machine, for housing therein a plurality of products arranged in the longitudinal direction, the product housing apparatus comprising: a product passage defined by a product rack horizontally extended in the longitudinal direction and left and right partition walls which face each other while leaving a space therebetween in the lateral direction, are extended upward from the product rack, and are extended parallel to each other in the longitudinal direction, the plurality of products being housed in the product passage in the state of being arranged in the longitudinal direction and being abutted against each other; and a convex member which is provided between the left and right partition walls of the product rack so as to extend along the product passage and locks the plurality of products so as to be held in a laid state and in a position inclined on the lower right direction and/or the lower left direction. By virtue of this constitution, inexpensive product housing apparatus and product housing method for a vending machine are provided which can house, in a product passage horizontally extended in the longitudinal direction, various products including, for example, thin products, bagged products, and wrapped products, in the state of being arranged in the longitudinal direction, and, at the same time, can properly and surely deliver the products.

14 Claims, 8 Drawing Sheets

PRODUCT HOUSING APPARATUS AND PRODUCT HOUSING METHOD FOR VENDING MACHINE

FIELD OF THE INVENTION

The invention relates to a product housing apparatus and a product housing method for a vending machine, for housing therein a plurality of products arranged in the longitudinal direction which, at the time of selling, are pushed forward from behind to deliver a product. More particularly, the invention relates to a product housing apparatus and a product housing method for a vending machine, for housing therein, for example, thin products such as wrapping with an emblematic noshi decoration printed on it (noshi bukuro), bagged products such as snack confectionery, and wholly wrapped products (hereinafter referred to as "wrapped products") such as box lunches.

BACKGROUND OF THE INVENTION

Conventional vending machines wherein products housed in a product passage horizontally extended in the longitudinal direction are pushed forward to deliver a product, particularly the so-called "see-through type vending machines" wherein a purchaser of the product can see products housed in the vending machine through a transparent front door, and that utilize a spiral member which extends spirally in the longitudinal direction, for selling the thin products or bagged products as described above. This spiral member is provided so as to have a plurality of spaces at equal pitches in the longitudinal direction, and is disposed within the product passage. Each product is housed within the product passage in a substantially stood-up position in the state of being inserted into the space in the spiral member. At the time of selling, the spiral member is rotated by substantially one turn about an axis extended in the longitudinal direction to advance products by one pitch while pushing. The rotation of the spiral member in this way permits all the products housed in the product passage to be moved forward, and, when the spiral member has been rotated at a predetermined angle, the product located at the forefront in the product passage (hereinafter referred to as "forefront product") is delivered forward from the delivery port located at the front end of the product passage.

On the other hand, for products other than the thin products and the bagged products, for example, for canned beverage products and the above-described wrapped products, they are placed in the state of being arranged in the longitudinal direction on a bottom wall constituting the bottom of the product passage to house products in the product passage. All the products housed in this way are pushed from behind, for example, by means of a pusher which is driven forward along the product passage so as to be advanced forward, whereby the forefront product is delivered forward through the delivery port in the product passage.

In the vending machine provided with the spiral member, a large number of spiral members should be provided according to the size and shape of the products. Specifically, in order to properly deliver the products forward in a substantially stood-up position, it is necessary to use a spiral member which has a diameter close to the outside dimension of the product and has a space somewhat larger than the thickness of the products. Therefore, in order to sell a variety of products having various sizes and thicknesses, a plurality of types of spiral members should be provided according to the types of the products. This disadvantageously increases the cost.

Further, in the case of vending machines provided, for example, with a bucket which is moved between a position in the vicinity of the delivery port of the product passage and a product take-out port and receives the product, delivered from the product passage, at a position in the vicinity of the delivery port in the product passage, a failure to deliver is likely to occur particularly in delivering a thin product from the product passage to the bucket. More specifically, an unavoidable gap occurs between the bucket moved around the delivery port in the product passage and the delivery port in the product passage. In delivering a product having a smaller thickness than this gap, for example, a telephone card, from the product passage to the bucket, there is a fear that the product enters the gap, or otherwise the product drops downward through the gap, resulting in a failure to properly deliver the product to the bucket. It is a matter of course that the failure to deliver can be prevented by providing a mechanism which, at the time of the delivery of the product, can clog the gap, between the bucket and the delivery port in the product passage, from the upper part thereof and functions as a bridge for delivering the product from the product passage to the bucket. The provision of this mechanism disadvantageously increases the cost.

On the other hand, in vending machines provided, for example, with a pusher for pushing the product, a failure to deliver products is likely to occur for some products. Specifically, for example, when wrapped products are housed in the product passage in such a state that they are merely placed on the bottom wall in the product passage, the lower surface of the wrapped product is brought into intimate contact with the bottom wall in the product passage. This often causes large frictional force between the wrapped products and the bottom wall in the product passage. For this reason, in some cases, the pusher driving force is unsatisfactory for delivering the wrapped products, even though this driving force suffices for advancing canned beverage products or the like. In this case, the wrapped products cannot be properly advanced. As a result, a failure to deliver the products occurs.

SUMMARY OF THE INVENTION

The invention has been made with a view to solving the above problems of the prior art, and it is an object of the invention to provide inexpensive product housing apparatus and product housing method for a vending machine which can house, in a product passage horizontally extended in the longitudinal direction, various products including, for example, thin products, bagged products, and wrapped products, in the state of being arranged in the longitudinal direction, and, at the same time, can properly and surely deliver the products.

According to the first feature of the invention, there is provided a product housing apparatus for a vending machine, for housing therein a plurality of products arranged in the longitudinal direction which, at the time of selling, are pushed forward from behind to deliver a product, said product housing apparatus comprising:

a product passage defined by a bottom wall horizontally extended in the longitudinal direction and left and right side walls which face each other while leaving a space therebetween in the lateral direction, are extended upward from the bottom wall and, at the same time, are extended parallel to each other in the longitudinal direction, the plurality of products being housed in the product passage in the state of being arranged in the longitudinal direction and being abutted against each other; and a product locking section which is provided between the left and right side walls of the bottom wall so as to extend along the product passage and locks the plurality of products so as for the products to be held in a laid state and in a position inclined in the lower right direction and/or the lower left direction.

According to this construction, a plurality of products to be arranged in the longitudinal direction for housing in the state of being abutted against each other in a product passage defined by the bottom wall and the left and right side walls are locked by a product locking section provided between the left and right side walls of the bottom wall. This permits the products to be held in a laid state and in a position inclined in the lower right direction and/or the lower left direction. More specifically, for example, ① two products abutted against each other are housed in the product passage so as to cross each other by locking two products abutted against each other in such a manner that one of the two products is held in a position inclined in the lower right direction while the other product is held in a position inclined in the lower left direction (hereinafter referred to as "cross housing"). Alternatively, ② all the products are locked so as to be held in a position inclined in an identical direction, that is, the lower right direction or the lower left direction, at substantially the same angle to house them in the product passage (hereinafter referred to as "identically inclined housing"). At the time of selling, the plurality of products housed in the product passage in this way are pushed forward from behind, whereby, while maintaining the position in the housed state, the products are moved forward along the product passage while being guided by the locking section, and then delivered.

As described above, the plurality of products housed in the product passage are housed in a laid state and in a position inclined in the lower right direction and/or the lower left direction. In particular, when the products to be housed are thin products, these products are housed by cross housing. By virtue of this, simply pushing these products forward from behind permits the products to be delivered from the product passage. Therefore, unlike the prior art, even when products to be housed are thin products or bagged products, there is no need to provide a large number of types of spiral members according to the products housed in the product passage. As a result, a product housing apparatus, which can house various products including thin products and bagged products, can be realized at low cost. Further, when the bucket is moved to the vicinity of the delivery port in the front end of the product passage to receive the product delivered from the product passage and, at the same time, when the product is a thin product or a bagged product, the product is delivered while being moved forward by at least the depth in a laid state (the lateral width or longitudinal width of the product). Further, at that time, since the depth is generally larger than the gap between the bucket and the delivery port, for example, the entry of the product into the gap can be surely prevented. This permits the product to be properly and surely delivered (handed) to the forward bucket. Further, even when the product to be housed in the product passage is a product which, when housed by merely placing the product on the bottom wall, causes large frictional force between the product and the bottom wall, such as wrapped products, the frictional force can be significantly reduced by housing the product in a position inclined in the lower right direction or the lower left direction, because the product comes into line contact with the bottom wall to give a very small contact area. As a result, as compared with the prior art, wrapped products and the like can be smoothly and surely delivered forward, and, thus, a failure to deliver products can be prevented.

In the product housing apparatus according to the first feature of the invention, preferably, the product locking section comprises a convex which is projected upward from the bottom wall and locks the plurality of products.

According to this construction, the product locking section can be constituted by a convex projected upward from the bottom wall and having a simple construction in a low-cost and simple manner.

In this product housing apparatus, preferably, the convex is disposed at a substantially center portion between the left and right side walls of the bottom wall.

According to this construction, a convex is disposed at a substantially center portion between the left and right side walls of the bottom wall. Therefore, products abutted against each other can be allowed to cross each other in the vicinity of the upper end of the convex, and housed orderly within the product passage symmetrically with respect to the left and right about the convex.

In the above product housing apparatus, preferably, the convex is constructed so as to be detachable from the bottom wall and attachable to a plurality of positions between the left and right side walls of the bottom wall.

According to this construction, the convex is detachable to the bottom wall, and is attachable to a plurality of positions of the bottom wall in the lateral direction. Therefore, the form of housing can be freely and easily switched between cross housing and identically inclined housing, for example, according to the size or shape of the product to be housed. Specifically, when a convex is mounted on a center portion between the left and right side walls of the bottom wall, the products can be housed by the cross housing, while when the convex is mounted at a position which is closer to any one of the left and right side walls than the other side wall, the products can be housed by the identically inclined housing. Further, since the convex is detachable from the bottom wall, when products which require neither cross housing nor identically inclined housing, for example, products which can be placed in a self-stood-up position on the bottom wall, such as canned beverage products, are housed in the product passage, the removal of the convex from the bottom wall can easily cope with this.

In any one of the above product housing apparatuses, preferably, the surface of the convex is formed of a material having a sliding property.

According to this constitution, the surface of the convex has a sliding property. Therefore, when the products locked by the convex are pushed forward from behind, they can be smoothly delivered forward.

In the product housing apparatus according to the first feature of the invention, preferably, the product locking section comprises a concave which is provided on the upper surface of the bottom wall and functions to lock the lower end of the plurality of products housed in the inclined position in the product passage.

According to this construction, the product locking section for locking the lower end of the plurality of products housed in an inclined position can be formed by the concave having a simple structure provided on the upper surface of the bottom wall in a low-cost and simple manner.

In the above product housing apparatus, preferably, the concave is provided at a substantially center portion between the left and right side walls of the bottom wall.

According to this construction, a concave is provided at a substantially center portion between the left and right side walls of the bottom wall. Therefore, products abutted against each other can be allowed to cross each other in the concave, and housed orderly within the product passage symmetrically with respect to the left and the right about the concave.

In the above product housing apparatus, two concaves may be provided, symmetrically with respect to the left and the right, between the left and right side walls of the bottom wall.

According to this construction, locking a product in its lower end in the left concave out of the two concaves provided symmetrically with respect to the left and the right permits the product to be housed in a position inclined in the lower left direction, while locking another product in its lower end in the right concave permits this product to be housed in a position inclined in the lower right direction. This enables the products abutted against each other to be easily housed by cross housing and, at the same time, the products to be orderly housed symmetrically with respect to the left and the right.

In any one of the above product housing apparatuses, preferably, at least one of the left and right side walls is constructed so as to be detachable from the bottom wall and attachable to a plurality of positions in the lateral direction of the bottom wall.

According to this construction, at least one of the left and right side walls is detachable to the bottom wall, and is attachable to a plurality of positions of the bottom wall in the lateral direction. Therefore, the width in the lateral direction of the product passage can be freely and easily increased or reduced, for example, according to the size or shape of the product to be housed in the product passage.

Preferably, the above product housing apparatus further comprises a detachable cover which is extended in the longitudinal direction along the left and right side walls and covers, from the product passage side, a gap between the bottom wall and at least one of the left and right side walls.

According to this construction, even when a gap occurs between the bottom wall and the left or right side wall at the time of mounting of the left and right side walls on the bottom wall, the covering of the gap with a cover from the product passage side can surely prevent accidental entry of the product in its end (a front end in the case of thin products, and a double leaved ear portion in the case of bagged products) into the gap at the time of housing or delivery of products.

In the above product housing apparatus, the cover on its surface of the product passage side is preferably formed of a material having a sliding property.

According to this construction, since the surface of the cover on its product passage side has a sliding property, the product housed in contact with the cover can be smoothly advanced by pushing the product forward from behind.

Any one of the above product housing apparatuses may further comprise a product delivery sensor which comprises a light emitting device and a photodetector located around a delivery port of the front end of the product passage and provided so as to horizontally face each other in the lateral direction and detects the delivery of a product from the product passage based on whether or not light from the light emitting device has been received by the photodetector.

According to this construction, the product delivery sensor comprising the light emitting device and the photodetector detects a product which is delivered while maintaining the position provided at the time of housing. Specifically, the detection is made based on whether or not, in passing the product, which is in a laid state and held in a position inclined in the lower right direction or the lower left direction, through between the light emitting device and the photodetector, the photodetector has received light from the light emitting device. In this case, for example, when the product to be delivered is a thin product, the height of the product in the vertical direction is larger by the degree of inclination than that in the case where the product is delivered in the horizontally laid state. Accordingly, the delivery of this product can be surely detected by properly setting the angle of inclination of the product so as to apply light from the light emitting device to the product.

According to the second feature of the invention, there is provided a product housing method for a vending machine, for housing a plurality of products which are abutted against each other and arranged in the longitudinal direction in a product passage horizontally extended in the longitudinal direction and, at the time of selling, are pushed forward from behind to deliver a product, wherein one of the plurality of the products is housed, within the product passage, in a laid state and in a position inclined in one of the lower right direction and the lower left direction, and the other product abutted against said one product is housed, within the product passage, in a laid state and in a position inclined in the other direction.

According to this construction, when a plurality of products are housed in a product passage horizontally extended in the longitudinal direction, one of the plurality of products is first housed in a laid state and in a position inclined in any one of the lower right direction and the lower left direction. Next, on the front or rear side of the one product, another product is abutted against this one product, and housed in a laid state and in a position inclined in other direction. That is, in housing the plurality of products, they are successively arranged in the longitudinal direction in a laid state and in positions inclined alternately in the lower right direction and the lower left direction (cross housing). This cross housing permits the plurality of products housed in the product passage to be delivered from the product passage by simply pushing the products forward from behind. Therefore, even when products to be housed in the product passage are thin products or bagged products, unlike the prior art technique, various products including thin products and bagged products can be housed without utilizing a large number of types of spiral members according to the products housed in the product passage.

Further, when the bucket is moved to the vicinity of the delivery port in the front end of the product passage to receive the product delivered from the product passage and, at the same time, when the product is a thin product or a bagged product, housing the products in the product passage by the cross housing permits the product to be delivered while being moved forward by at least the depth in a laid state (the lateral width or longitudinal width of the product). Further, at that time, since the depth is generally larger than the gap between the bucket and the delivery port, for example, the entry of the product into the gap can be surely prevented. This permits the product to be properly and surely delivered forward. Further, even when the product to be housed in the product passage is a product which, when housed by merely placing the product on the bottom wall constituting the bottom of the product passage, causes large frictional force between the product and the bottom wall, such as wrapped products, the cross housing of the products can significantly reduce the frictional force, because the product comes into line contact with the bottom wall to give a very small contact area. As a result, as compared with the prior art, wrapped products and the like can be smoothly and surely delivered forward, and, thus, a failure to deliver products can be prevented.

According to the third feature of the invention, there is provided a product housing method for a vending machine, for housing a plurality of products which are abutted against each other and arranged in the longitudinal direction in a product passage horizontally extended in the longitudinal direction and, at the time of selling, are pushed forward from behind to deliver a product, wherein the plurality of products are housed, within the product passage, in a laid state and in a position inclined at substantially the same angle in any one of the lower right direction and the lower left direction.

According to this construction, when a plurality of products are housed in a product passage horizontally extended in the longitudinal direction, they are arranged in the longitudinal direction in the state of being abutted against each other and, at the same time, are successively housed, within the product passage, in a laid state and in a position inclined at substantially the same angle in any one of the lower right direction and the lower left direction (identically inclined housing). Therefore, even when the plurality of products to be housed in the product passage are thin products or bagged products, the adoption of the identically inclined housing method permits various products including thin products and bagged products to be housed without utilizing the spiral member, as with the product housing apparatus according to the second feature of the invention. In addition, products can be properly and surely delivered forward. Further, even when the product to be housed in the product passage is, for example, a wrapped product, the product can be smoothly and surely delivered forward, and, thus, a failure to deliver products can be prevented.

BRIEF DESCRIPTION OF THE DRAWINGS

The invention will be explained in more detail in conjunction with the appended drawings, wherein:

FIG. 8 is a diagram illustrating the product housing apparatus and product housing method according to the fourth preferred embodiment of the invention, wherein FIG. 9 is a diagram illustrating the product housing method according to the fifth preferred embodiment of the invention, wherein

DESCRIPTION OF THE PREFERRED EMBODIMENTS

Figure 1:
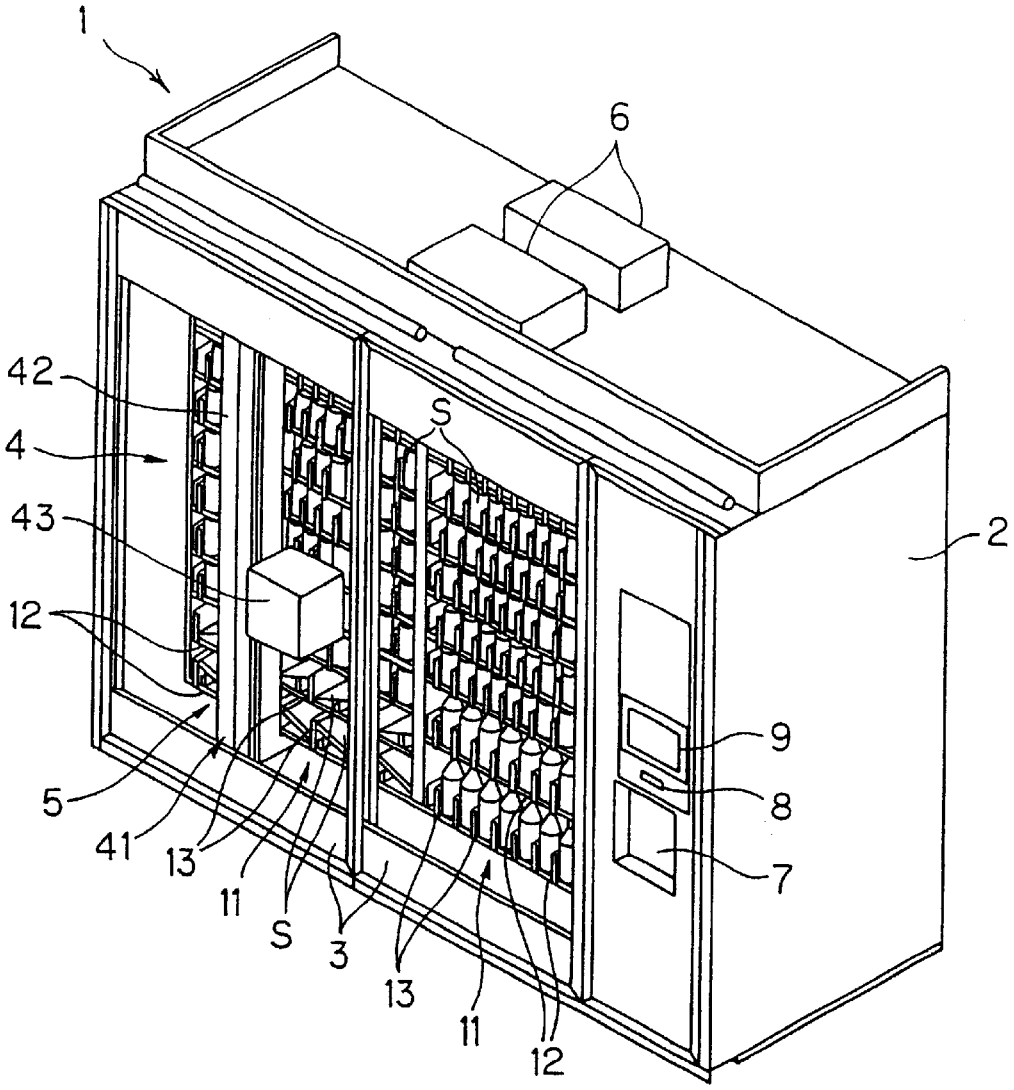
FIG. 1 is a perspective view showing a vending machine with the product housing apparatus according to a preferred embodiment of the invention being incorporated therein.

Preferred embodiments of the invention will be explained in more detail with reference to the accompanying drawings. FIG. 1 shows a vending machine with the product housing apparatus according to a preferred embodiment of the invention being incorporated therein. A vending machine 1 shown in the drawing is of the so-called "showcase type" wherein various products S including thin products, bagged products, and wrapped products are housed in the state of being arranged in the longitudinal direction within a large box-shaped vending machine body 2 and, in addition, the products S are seen through transparent front doors 3, 3. The vending machine 1 comprises: the vending machine body 2; a product housing apparatus 4 for storing products S; a product carry-out device 5 for carrying out products S at the time of selling; and the like.

In the vending machine body 2, two left and right doors 3, 3 are mounted on the opened front face. The doors 3 each are usually locked in a closed state, and are opened, for example, at the time of the supplement of products S so that the products S are supplemented from the front. A cooling unit 6 for cooling the products S is provided on the top of the vending machine body 2. On the right side of the front doors 3, 3 are provided a product take-out port 7, a card slot 8 for inserting a prepaid card or the like at the time of purchase of a product S and a cash inlet port (not shown) for putting a cash into the vending machine, and a control panel 9 comprising a selection button (not shown) for inputting product numbers assigned respectively to the products S and a display unit (not shown), for example, for displaying the input product number and the balance in a card. A control circuit (not shown) comprising a microcomputer for performing various types of control within the vending machine body 2 including the product carry-out device 5 is provided on the backside of the control panel 9.

The product housing apparatus 4 is in a box form and comprises: two left and right product storing chambers 11, 11 of which the front face is opened; a plurality of product racks 12 (bottom walls) which are horizontally supported between left and right side walls in each of the product storing chamber 11 and are provided in the vertical direction; and a plurality of partition walls 13 (side walls) which are mounted in the lateral direction on each product rack 12 at predetermined intervals, are extended upward, and are extended in the longitudinal direction parallel to each other. A product passage 14 is defined by the product rack 12 and the partition walls 13, 13 which are mounted on the product rack 12 and faces each other in the lateral direction (see FIGS. 2 and 3). A plurality of product passage 14 of this type are provided on the product rack 12. A large number of products S of the same item are housed in the state of being arranged in the longitudinal direction in each product passage 14.

In the product storing chamber 11 on the left side, an adiabatic wall (not shown) is provided between two lowermost located product racks 12, 12 and a product rack 12 located above these two product racks 12, 12, and a space, wherein the two lowermost located product racks 12, 12 are provided, is a room temperature chamber. Products which are not required to be cooled, for example, thin products such as wrapping with an emblematic noshi decoration printed on it (noshi bukuro), and bagged products such as snack confectionery, are housed in each product passage 14 in the room temperature chamber.

Figure 2:
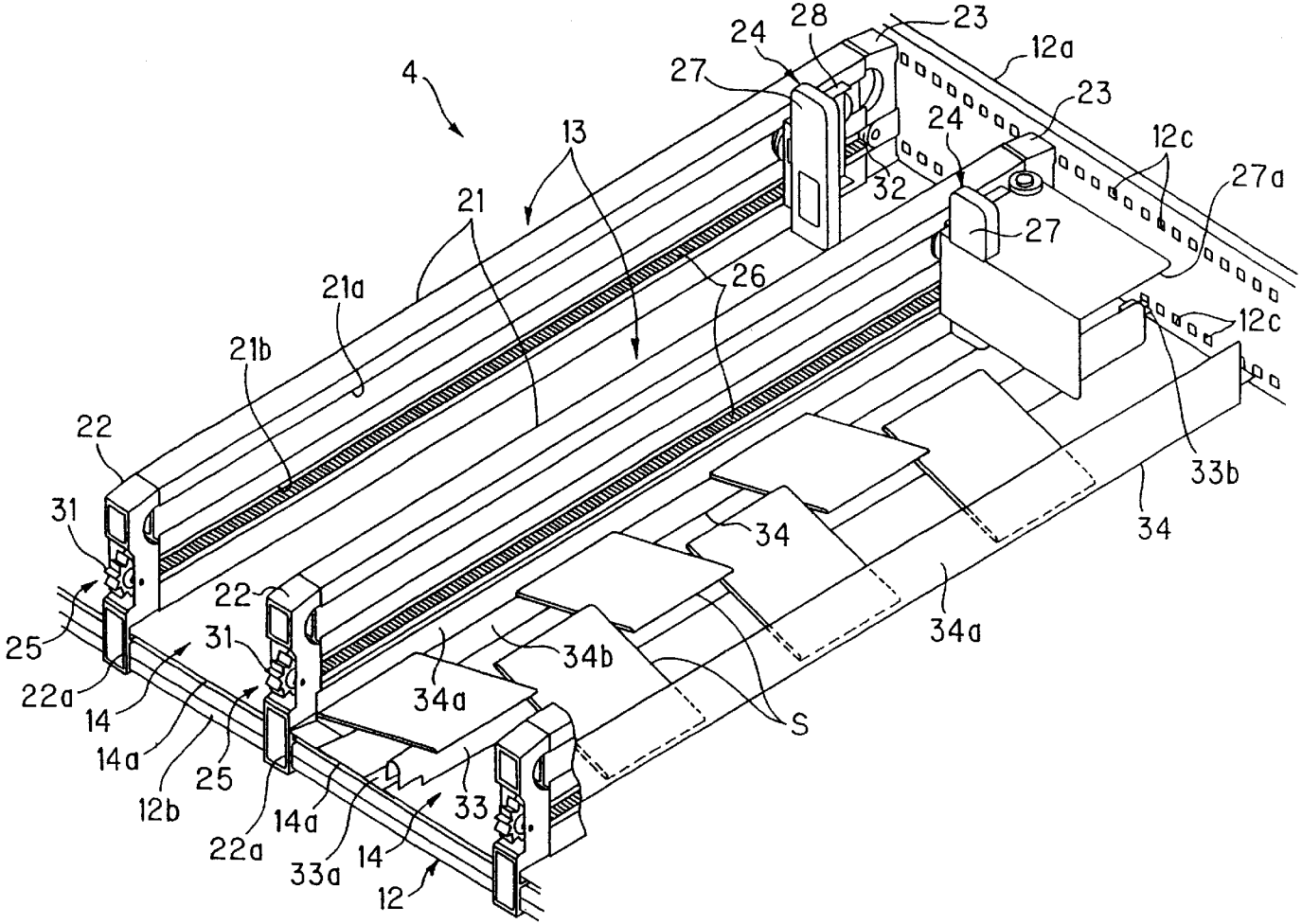
FIG. 2 is a perspective view showing thin products housed by cross housing in a product passage of the product housing apparatus shown in FIG. 1.
Figure 3:
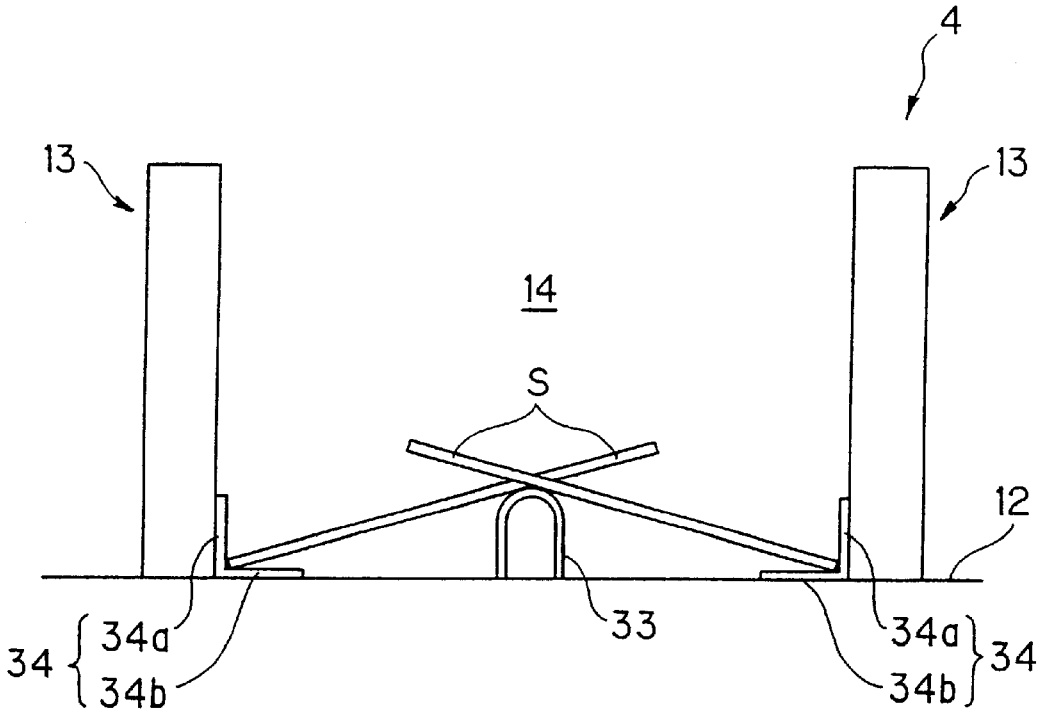
FIG. 3 is a schematic cross-sectional view of a portion of and around the product passage shown in FIG. 2, cut in the lateral direction.

FIG. 2 shows thin products which have been housed by cross housing in a product passage 14 in a room temperature chamber, and FIG. 3 schematically shows the product passage 14 shown in FIG. 2, cut in the lateral direction. As shown in FIG. 2, the partition wall 13 comprises: a partition wall body 21 extended in the longitudinal direction; a front mounting section 22 and a rear mounting section 23 which are mounted respectively on the front end and the rear end of the partition wall body 21 and are adapted for mounting the partition wall 13 per se on the product rack 12; a pusher 24 which is provided so as to face the product passage 14 from the right side face of the partition wall body 21 and, upon forward movement, pushes the products S housed in the product passage 14 forward from behind; and a pusher drive mechanism 25 for driving this pusher 24 forward.

The partition wall body 21 is formed of an aluminum extruded section, and two upper and lower grooves (an upper groove 21*a* and a lower groove 21*b*), which are extended parallel to each other in the longitudinal direction and are opened on the right side, are provided on the right side face. The pusher 24 is slidably fitted into the upper groove 21*a*. On the other hand, a timing belt 26 for the pusher drive mechanism 25 described below is disposed within the lower groove 21*b*.

The front mounting section 22 and the rear mounting section 23 each are formed of, for example, a resin or a hard rubber, and are constructed so as to be attachable to and detachable from the front end of the product rack 12 and a back wall 12*a* in the rear end of the product rack 12. More specifically, the front mounting section 22 is mounted on the front end of the product rack 12 by inserting from the front a front wall 12*b* of the product rack 12 into a fitting section 22*a* provided on the lower end of the front mounting section 22 and having a "⊃" shape in its side section so as to be sandwiched between the upper and lower parts of the fitting section 22*a*. On the other hand, a large number of through holes 12*c* are provided at predetermined pitches in the lateral direction on the upper end and the lower end of the back wall 12*a* in the product rack 12. Two upper and lower projections (not shown) provided on the rear end face of the rear mounting section 23 are inserted respectively into the two upper and lower through holes 12*c*, 12*c* to mount the rear mounting section 23 on the back wall 12*a* of the product rack 12. Thus, the partition wall 13 is attachable to and detachable from the product rack 12, and is attachable to a plurality of positions in the lateral direction on the product rack 12. Therefore, the mounting position of one of or both the left and right partition walls 13, 13 can be varied, for example, according to the size or shape of products S to be housed in the product passage 14 to freely set the lateral width of the product passage 14.

The pusher 24 comprises a plate pusher body 27 and a pusher support 28 which supports the pusher body 27, can be slidably fitted into the upper groove 21*a* of the partition wall body 21, and is fixed to the timing belt 26 within the lower groove 21*b*. Therefore, the pusher 24 is movable in the longitudinal direction along the upper groove 21*a* in the partition wall body 21, and, while being moved forward upon the rotation of the timing belt 26 in a predetermined direction, the pusher 24 pushes the products S housed in the product passage 14 forward from behind.

As shown in FIG. 2, when the width in the lateral direction of the product passage 14 is so large that the products S cannot be property pushed by the pusher body 27 alone, a pusher adapter 27*a* is mounted on the pusher body 27. This pusher adapter 27*a* has an "L" shape in its side section, and is extended toward the right side from the center portion between the left and right partition walls 13, 13.

The pusher drive mechanism 25 comprises: a front gear 31 and a rear gear 32 rotatably mounted respectively on the front mounting section 22 and the rear mounting section 23; and the timing belt 26 wrapped and placed around these gears 31, 32. The front gear 31 comprises a double spur gear of a large diameter and a small diameter. The large-diameter spur gear faces the exterior from the front end of the front mounting section 23, while the timing belt 26 is wrapped and placed around the small-diameter spur gear. On the other hand, the rear gear 32 is formed so as to have the same pitch as the small-diameter spur gear in the front gear 31. Therefore, upon the rotation of the large-diameter spur gear in the front gear 31 by means of a drive mechanism 46 provided in a bucket 43 described later, the timing belt 26 is rotated in a predetermined direction. This permits the pusher 24 to be moved forward, whereby a product S located at the forefront is delivered forward from a delivery port 14*a* located at the front end of the product passage 14.

As shown in FIG. 2, a convex member 33 (a product locking section, a convex) for housing the products S by cross housing is provided at the lower end of the product passage (a product passage on the right side) 14 housing therein thin products S. This convex member 33 is extended in the longitudinal direction along the product passage 14, and, at the same time, has a reverse "U" shape in a laterally cut section. The surface of the convex member 33 is formed of a material having a sliding property. Further, the convex member 33 is constructed so that the convex member 33 is attachable to and detachable from the surface of the product rack 12 by fitting the front end 33*a* and the rear end 33*b* of the convex member 33 respectively into the lower through hole 12*c* in the front wall 12*b* and the lower through hole 12*c* in the back wall 12*a* when the convex member 33 is attached to the product rack 12, and by removing the front end 33*a* and the rear end 33*b* of the convex member 33 respectively from the lower through hole 12*c* in the front wall 12*b* and the lower through hole 12*c* in the back wall 12*a* when the convex member 33 is detached from the product rack 12. That is, as with the partition wall 13, the convex member 33 is constructed to be attachable to a plurality of positions in the lateral direction. The convex member 33 having this construction is disposed at substantially the center between the left and right partition walls 13, 13.

Covers 34, 34 having an "L" shape in its section for covering the gap between the product rack 12 and the partition wall 13 from the product passage 14 side are provided respectively at left and right corners in the lower end of the product passage 14 housing therein thin products S. Each of the covers 34 comprises: a first cover piece 34*a* which is extended in the longitudinal direction along the partition wall 13 and is extended upward along the partition wall 13 in its face on the product passage 14 side; and a second cover piece 34*b* which continues from the lower end of the first cover piece 34*a* and is extended horizontally along the top surface of the product rack 12. The surface of the first and second cover pieces 34*a*, 34*b* on their product passage 14 side is formed of a material having a sliding property. Each cover 34 is constructed so that the cover 34 is attachable to and detachable from the surface of the product rack 12 in the same manner as described in connection with the convex member 33, that is, by fitting the front end and the rear end of the second cover piece 34*b* respectively into the front wall 12*b* and the back wall 12*a* when the cover 34 is attached to the product rack 12, and by removing the front end and the rear end of the second cover piece 34*b* respectively from the front wall 12*b* and the back wall 12*a* when the cover 34 is detached from the product rack 12. The cover 34 is constructed so as to be attachable to a plurality of positions in the lateral direction. Therefore, each cover 34 is mountable on the product rack 12 according to the position where the partition wall 13 is disposed. In this case, the first cover piece 34*a* and the second cover piece 34*b* are mounted so as to come into intimate contact respectively with the partition wall 13 and the product rack 12. These covers 34, 34 can surely prevent accidental entry of the product S in its end (a front end in the case of thin products, and a double leaved ear portion in the case of bagged products) into the gap between the product rack 12 and the partition wall 13 at the time of housing of products S in the product passage 14 or delivery of products S.

Thin products S are cross housed in the product passage 14 (the product passage on the right side in FIG. 2), wherein the convex member 33 and the covers 34, 34 are mounted on the product rack 12, by the following method. Specifically, at the outset, in one product S out of a plurality of products S to be housed, one end in the lateral direction of the one product S is abutted against the cover 34, while the one product S in its end opposite to the above one end with the center of gravity of the one product S being located between both ends of the one product S is abutted against the convex member 33 from its upper part. Thus, the product S is housed in the product passage 14. This permits one product S to be locked by the convex member 33 and the cover 34 and to be housed in a laid state while being held in a position inclined in one of the lower right direction and the lower left direction.

Next, another product S is abutted against the one product S on its front side or rear side, and, in addition, one end in the lateral direction of the another product S is abutted against the cover 34 opposite to the cover 34 abutted against the one product. At the same time, the another product S in its end opposite to the above one end with the center of gravity of the another product S being located between both ends of the another product S is abutted against the convex member 33 from its upper part. Thus, the another product S is housed in the product passage 14. This permits the another product S to be also locked by the convex member 33 and the cover 34 and to be housed in a laid state while being held in a position inclined in a direction opposite to the inclination direction of the one product.

The above two steps are alternately repeated to successively house products S in the product passage, whereby a plurality of products S are cross housed in the product passage 14.

The plurality of products S housed in each product passage 14 are carried to the product take-out port 7 by means of a product carry-out device 5 disposed in front of the product storing chambers 11, 11. As shown in FIG. 1, the product carry-out device 5 comprises: a Y module 41 which is provided in front of the product storing chamber 11 so as to be movable in the lateral direction; a mechanism for driving in a direction X (not shown) which drives the Y module 41 in the lateral direction; and the like. The Y module 41 comprises: a movable body 42 which is in a vertically extended oblong box form and is laterally driven by means of the mechanism for driving in the direction X; a bucket 43 which is provided in a projected state on the right side face of the movable body 42 and is vertically movable with respect to the movable body 42; and a mechanism for driving in a direction Y (not shown) which is built in the movable body 42 and drives the bucket 43 in the vertical direction with respect to the movable body 42.

Figure 4:
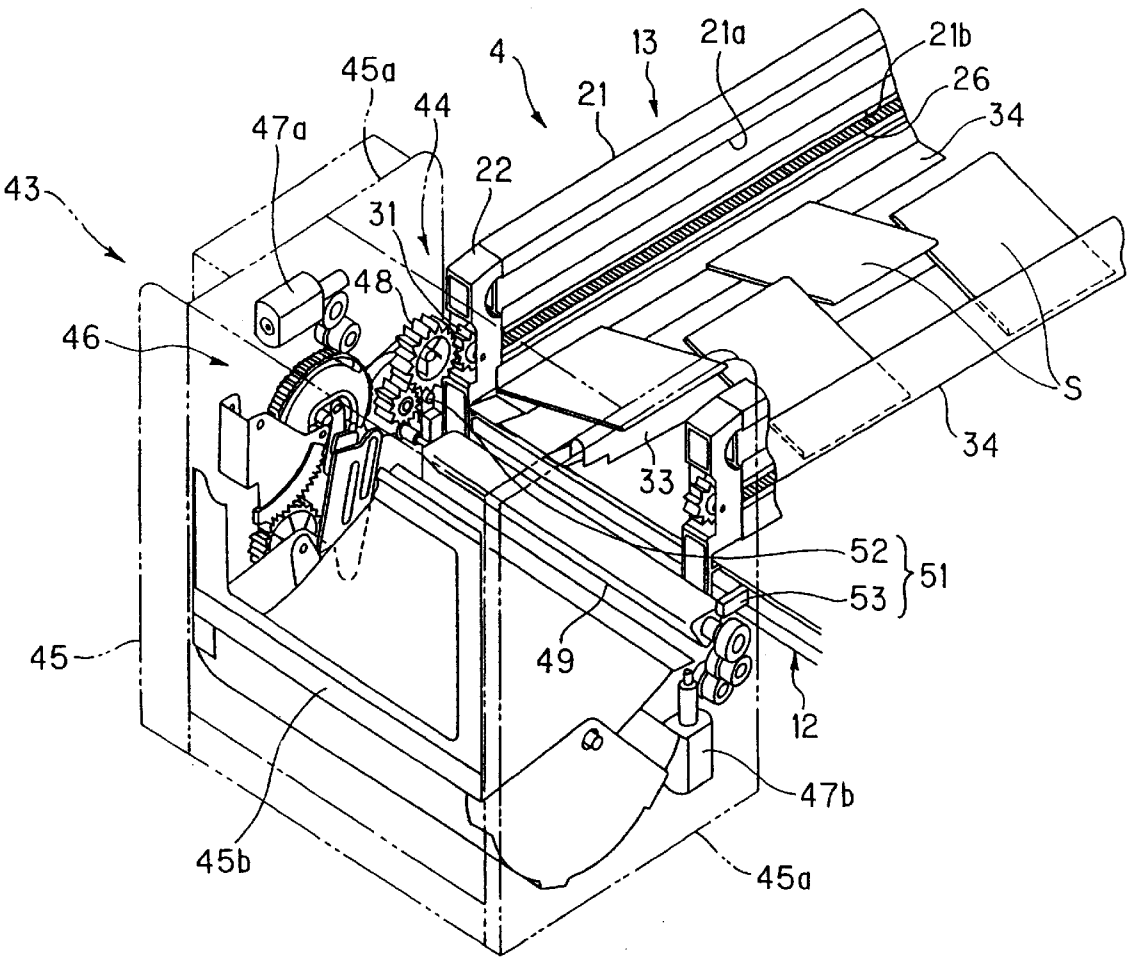
FIG. 4 is a perspective view showing the start of the delivery of a product after the movement of a bucket in front of a delivery port of the product passage at the time of selling.

At the time of selling, the bucket 43 is vertically and laterally moved by the mechanism for driving in direction X and the mechanism for driving in direction Y, receives the product S, delivered from the product passage 14, around the delivery port 14*a* in the product passage 14, and conveys and carries the delivered product S to the product take-out port 7. As shown in FIG. 4, the bucket 43 comprises: a box-shaped bucket body 45 having a product housing opening 44 which has been opened largely toward the back side; a drive mechanism 46 for driving the pusher drive mechanism 25 or the like; and the like. The drive mechanism 46 has two motors 47*a*, 47*b* and a drive gear 48 which, upon the operation of these motors 47*a*, 47*b* at the time of selling, is projected toward the back of the rear end of the bucket body 45 and is rotatively driven. A triangular drum 49, which is extended horizontally in the lateral direction and a triangular shape in its side section, is provided at the rear end of the bucket body 45 so as to face the product housing opening 44 from the underside. This triangular drum 49 is constructed so as to be rotatively driven by means of a motor 47*b*, and, in delivering a product S, is rotated so as to be delivered forward while supporting the product S from its underside, whereby the product S is efficiently housed within the bucket body 45.

Further, a product delivery sensor 51 for detecting the completion of the delivery of the delivered product S to the bucket 43 is provided at a position in the rear end of the bucket body 45 and somewhat above the triangular drum 49. This product delivery sensor 51 comprises a pair of photosensor comprising a light emitting device 52 and a photodetector 53. Both the devices 52, 53 horizontally face each other, and are mounted respectively on the left and right side walls 45*a*, 45*a* of the bucket body 45 so that light from the light emitting device 52 is received by the photodetector 53. When the bucket 43 receives the product S, that is, when the product S passes through between the light emitting device 52 and the photodetector 53, light applied from the light emitting device 53 toward the photodetector 53 is once cut off by the product S being passed. Thereafter, the photodetector 53 again receives the light. This is the time when the delivery of the product S to the bucket 23 has been completed. The completion of the delivery is recognized by the control circuit (not shown).

At the time of selling, upon the operation of the product carry-out device 5 provided with the bucket 43 having the above construction, a product S located at the forefront out of the plurality of products S housed in the product passage 14 is first housed in the bucket 43. More specifically, the bucket 43 is first moved to and stopped at a position around the delivery port 14*a* of the product passage 14 housing a product S selected by the purchaser. The drive gear 48 engages with the front gear 31 in the pusher drive mechanism 25, and is rotated in a predetermined direction to drive the pusher 24 forward, whereby a plurality of products S housed in the product passage 14 are pushed forward from behind by the pusher 24. In this case, as shown in FIGS. 2 to 4, the products S housed in the product passage 14 by cross housing is pushed forward by the pusher 24 in such a state that.one end in the lateral direction and a portion opposite to the one end with the center of gravity being located between both the ends are locked by any one of the left and right covers 34 and the convex member 33. Therefore, while the products S are guided by the cover 34 and the convex member 33, they are delivered forward, with the position provided at the time of housing of the products being maintained, without causing a trouble such that products located in the rear run on or are slipped under products located in the front. The product S located in the forefront is delivered forward through the delivery port 14*a* of the product passage 14. As soon as the product delivery sensor 51 detects the receipt and housing of the forefront product S in the bucket 43 through the product housing opening 44, the rotation of the drive gear 48 is stopped to stop the forward movement of the pusher 24.

Thereafter, the bucket 43 housing therein products S is moved in the rear of the product take-out port 7, and a bucket door 45*b* provided in the front face is opened to carry the product S to the product take-out port 7.

As described above in detail, according to the product housing apparatus 4 and product housing method according to the above preferred embodiment, when a plurality of products S are housed in the product passage 14, the convex member 33 mounted on the product rack 12 permits these products S to be housed by cross housing wherein the products S are arranged in the longitudinal direction in a laid state and in such a position that the products S are inclined alternately in the lower right direction and in the lower left direction. By virtue of the housing in this way, the products S can be delivered from the product passage 14 by simply pushing the products S from behind, without causing a trouble such that products located in the rear run on or are slipped under products located in the front. Therefore, unlike the prior art, even when products to be housed are thin products or bagged products, there is no need to provide a large number of types of spiral members according to the products housed in the product passage. As a result, a product housing apparatus 4, which can house various products including thin products and bagged products, can be realized at low cost. Further, in delivering a thin product S from a delivery port 14*a* in the product passage 14, the product S is delivered while being moved forward by at least the lateral width or the longitudinal width. In this case, since the lateral width or the longitudinal width is generally larger than the gap between the bucket 43 and the delivery port 14*a*, for example, the entry of the product S into the gap can be surely prevented, permitting the product S to be properly and surely delivered (handed) to a bucket 43 in front. Further, even when products S to be housed in the product passage 14 are those which, when housed merely in a laid state on the product rack 12, cause large frictional force between the products and the product rack 12, such as wrapped products, housing of the products S by the cross housing can significantly reduce the frictional force, because the products S come into line contact with the product rack 12 (cover 34) to give a very small contact area. As a result, as compared with the prior art, wrapped products and the like can be smoothly and surely delivered forward, and, thus, a failure to deliver products can be prevented.

Further, since the convex member 33 has a simple structure, the product locking section for cross housing products S can be simply constructed at low cost. In addition, the surface of the convex member 33 and the surface of the cover 34 on its product passage 14 side have a sliding property. Therefore, in pushing the product S locked by the convex member 33 and the cover 34 by means of the pusher 24, the product S can be smoothly delivered forward. Further, since the convex member 33 is disposed at a substantially center portion between the left and right partition walls 13, 13 in the product rack 12, products S abutted against each other can be allowed to cross each other around the upper end of the convex member 33, and can be orderly housed symmetrically about the convex member 33 with respect to the left and the right.

When the product delivery sensor 51 provided on the bucket 43 detects a product S delivered through the delivery port 14*a* in the product passage 14, the product S is delivered in a laid state and in a position inclined in the lower right direction or in the lower left direction. Therefore, the delivery of the product can be surely detected as compared with the detection of the product delivered in a horizontally laid state.

Figure 5:
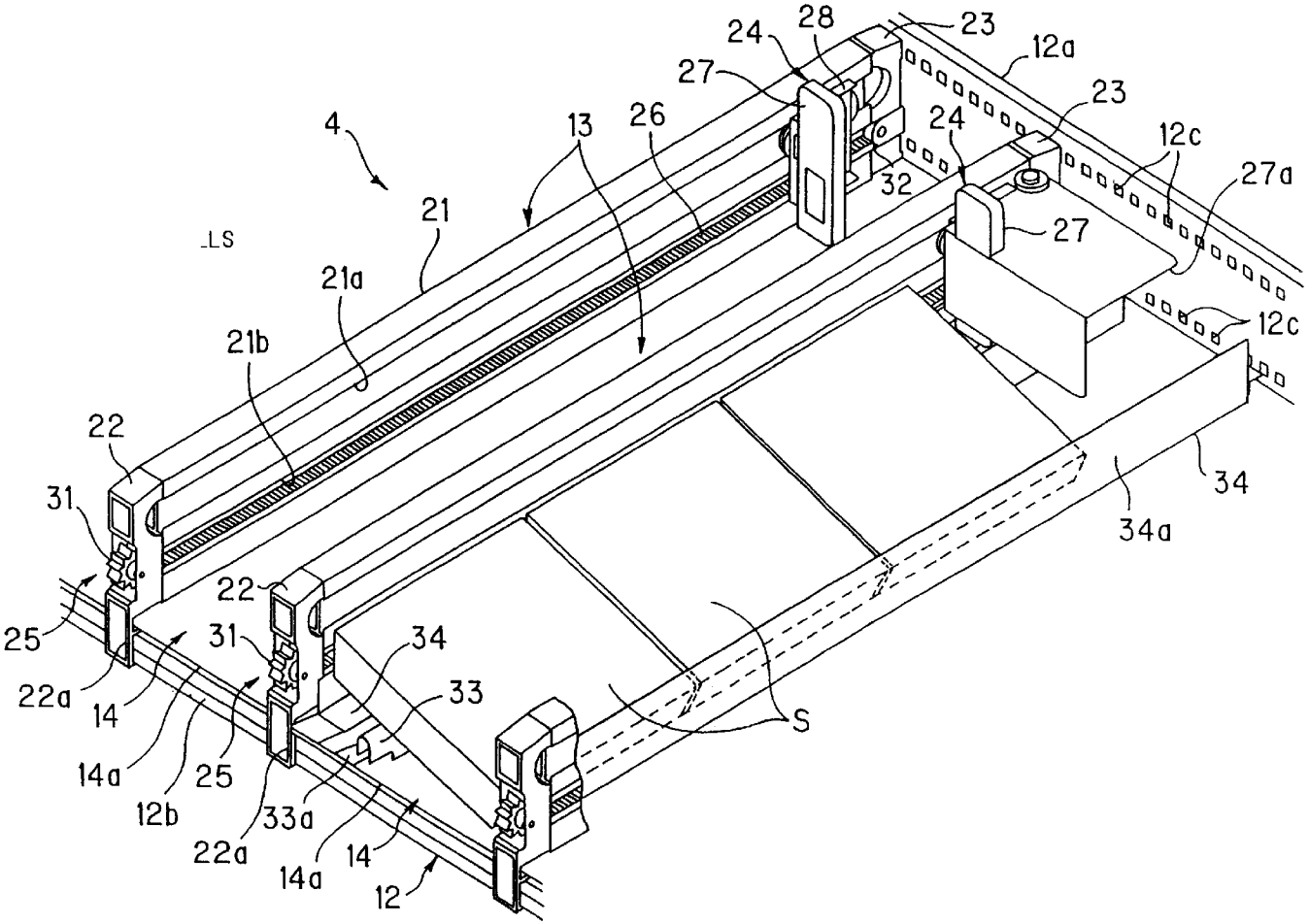
FIG. 5 is a perspective view showing wrapped products housed in a product passage by identically inclined housing, which illustrates the product housing apparatus and product housing method according to the second preferred embodiment of the invention.
Figure 6:
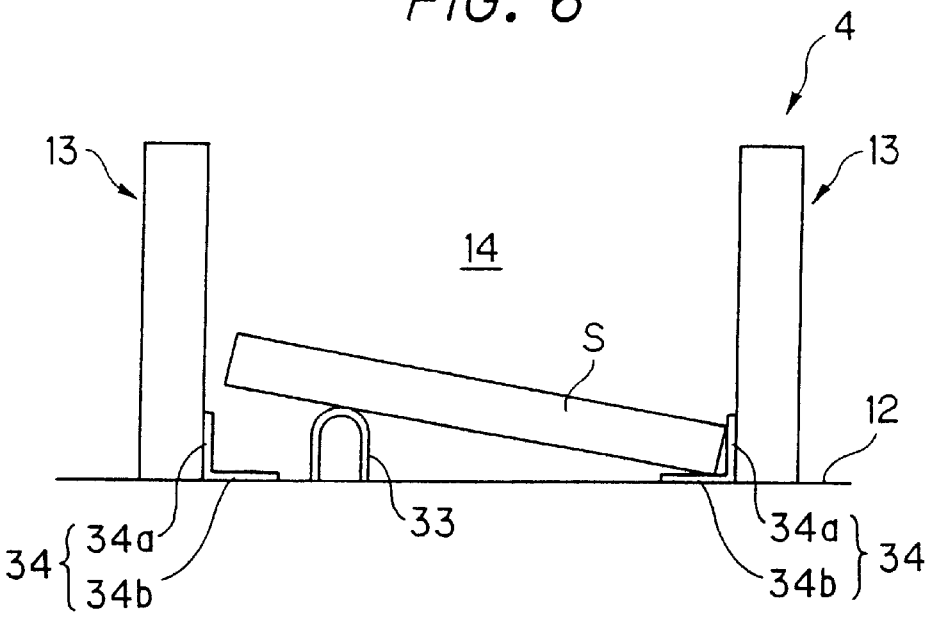
FIG. 6 is a schematic cross-sectional view showing, in a cut state, a portion of or around the product passage shown in FIG. 5.

Next, the product housing apparatus and product housing method according to the second preferred embodiment of, the invention will be explained in conjunction with FIGS. 5 and 6. The second preferred embodiment can be applied to housing of wrapped products, for example, packed lunches, in the product passage 14 by identically inclined housing. This product housing apparatus is the same as the product housing apparatus 4 according to the first preferred embodiment, except that the convex member 33 is provided at a position closer to the left partition wall 13 than the right partition wall.

When a plurality of products S are housed in this product housing apparatus 4, the right end in one of the plurality of products S is abutted against the right cover 34, while the left end is abutted against the convex member 33 from its upper part, thereby housing the one product S in the product passage 14. This permits the one product S to be housed in such a state that the one product S is locked by the convex member 33 and the right cover 34 and is held in a laid state and in a position inclined in the lower right direction. Next, another product S is housed in the same manner as used in the one product S in such a state that the another product S is abutted against the one product S on its front or rear side. Thus, as with the one product S, the another product S is locked by the convex member 33 and the right cover 34 and is housed in the state of being held in a position inclined at an angle substantially identical to the inclination angle of the one product S. Products S are successively housed in this way, whereby a plurality of products S are housed in the product passage 14 by identically inclined housing.

As with the first preferred embodiment, in the second preferred embodiment, the plurality of products S housed in the product passage 14 by identically inclined housing in the lower right direction are pushed forward from behind by the pusher 24 and consequently are delivered forward. More specifically, as shown in FIGS. 5 and 6, each product S housed in the product passage 14 is pushed forward by the pusher 24 in such a state that the right end and the left end are locked respectively by the right cover 34 and the convex member 33. Therefore, while maintaining the position provided at the time of housing, the products S are delivered forward while being guided by the right cover 34 and the convex member 33. Since each product S has certain thickness (substantial height in the vertical direction of the product), the product S can be advanced without causing a trouble such that, at the time of pushing by the pusher 24, products located in the rear run on or are slipped under products located in the front. The forefront product S is delivered forward through the delivery port 14*a* in the product passage 14, and handed to the bucket 43.

The product housing apparatus 4 and product housing method according to this preferred embodiment have the following effects in addition to substantially the same effect as attained by the first preferred embodiment. Specifically, since the convex member 33 is disposed at a position closer to the left partition wall 13 than the right partition wall 13, the inclination angle of the product S can be made smaller as compared with the housing of products by cross housing according to the first preferred embodiment. Therefore, in the case of products which, when housed in an inclined state, cause the contents to be easily crumbled, housing these products by the identically inclined housing method can suppress the crumbling of the contents.

The convex member 33 may be disposed at a position closer to the right partition wall 13 than the left partition wall to house products S by identically inclined housing in the lower left direction. Also in this case, the same effect as attained by the identically inclined housing in the lower right direction can be attained. Further, the product housing apparatus 4 and product housing method according to this preferred embodiment can be applied to the housing of the above-described wrapped product, as well as to the housing of thin products and bagged products. In this case, preferably, the products have certain thickness (height) from the viewpoint of avoiding such a trouble that, at the time of pushing by means of the pusher 24, products located in the rear run on or are slipped under products located in the front.

As described above, the convex member 33 is attachable to and detachable from the product rack 12, and can be attached to a plurality of positions in the lateral direction of the product rack 12. Therefore, the housing method can be freely and easily switched between cross housing and identically inclined housing according to the size and shape of the product S to be housed. Specifically, mounting the convex member 33 at a substantially center portion between the left and right partition walls 13, 13 in the product rack 12 enables products S to be cross housed. On the other hand, mounting the convex member 33 at a position closer to one of the left and right partition walls 13, 13 than the other partition wall enables products S to be housed by identically inclined housing. Further, since the convex member 33 is detachably mounted on the product rack 12, the removal of the convex member 33 from the product rack 12 suffices for housing of products which require neither cross housing nor identically inclined housing, for example, canned beverage products which can be housed in the product passage 12 by placing them in a self-stood-up state on the product rack 12.

Figure 7:
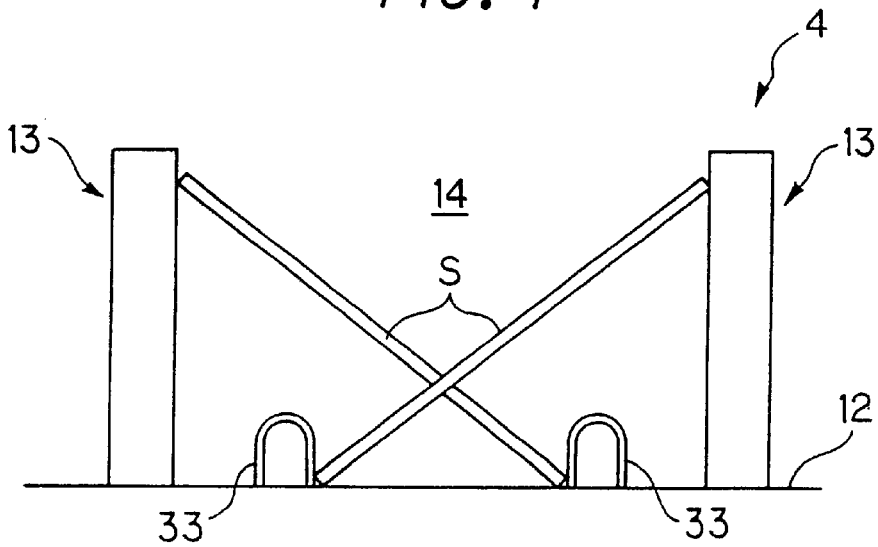
FIG. 7 is a schematic cross-sectional view showing products housed by cross housing in a product passage having two convex members provided, symmetrically with respect to the left and the right, between left and right partition walls of a product rack, which illustrates the product housing apparatus and product housing method according to the third preferred embodiment of the invention.

Next, the product housing apparatus and product housing method according to the third preferred embodiment of the invention will be explained in conjunction with FIG. 7. According to this preferred embodiment, two convex members 33, 33 are disposed symmetrically with respect to the left and the right between the left and right partition walls 13, 13 in the product rack 12. The product housing apparatus according to the third preferred embodiment is different from the product housing apparatus 4 according to the first preferred embodiment in this point only.

When a plurality of products S are housed in this product housing apparatus 4, for example, one product S in its left end is first abutted against a corner defined by the left convex member 33 and the product rack 12, while the right end is leaned against the right partition wall 13. This permits the one product S to be housed in the state of being locked by the left convex member 33 and the right partition wall 13 and held in a position inclined in the lower left direction. Another product S is then abutted against the one product S on its front or rear side, and, at the same time, the another product S in its right end is abutted against a corner defined by the right convex member 33 and the product rack 12 while the left end is leaned against the left partition wall 13. Thus, the another product S is housed in the product passage in the state of being locked by the right convex member 33 and the left partition wall 13 and held in a position inclined in the lower right direction. The above two steps are alternately repeated to successively house products S in the product passage, whereby a plurality of products S are cross housed in the product passage 14.

Accordingly, the product housing apparatus 4 and product housing method according to this preferred embodiment also have substantially the same effect as the product housing apparatus and product housing method according to the first preferred embodiment.

Figure 8A:
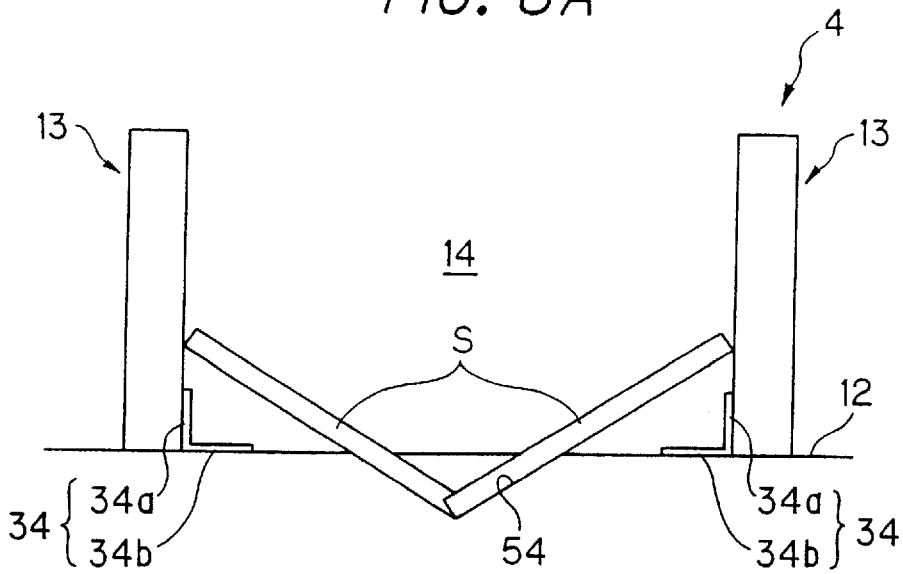
FIG. 8A is a schematic cross-sectional view showing products housed by cross housing in a product passage having a single concave provided between left and right partition walls of a product rack, and FIG. 8B a schematic cross-sectional view showing products housed by cross housing in a product passage having two left and right concaves provided between left and right partition walls of a product rack.

Next, the product housing apparatus and product housing method according to the fourth preferred embodiment of the invention will be described in conjunction with FIG. 8. The product housing apparatus 4 according to this embodiment is the same as the product housing apparatus according to the first preferred embodiment, except that, instead of the convex member 33 in the first preferred embodiment, a single concave 54 as a product locking section is provided at a substantially center portion between the left and right partition walls 13, 13 in the product rack 12 (see FIG. 8A), or that two concaves 54, 54 are provided symmetrically with respect to the left and the right between the left and right partition walls 13, 13 in the product rack 12 (see FIG. 8B).

Each concave 54 is provided on the product rack 12 so as to be extended horizontally in the longitudinal direction along the product passage 14 and to have a "V" shape in its section. When a plurality of products S are housed in a product passage 14 shown in FIG. 8A wherein the concave 54 is provided at a substantially center portion between the left and right partition walls 13, 13 in the product rack 12, for example, one product S is first housed in the product passage in such a state that the left end of the one product S is inserted into the concave 54 so as to be abutted against the bottom of the concave 54 while the right end is leaned against the right partition wall 13. Thus, the one product S is housed in the state of being locked by the concave 54 and the right partition wall 13 and held in a position inclined in the lower left direction. Next, another product S is abutted against the one product S on its front or tear side, and, at the same time, the right end of the another products S is inserted into the concave 54 so as to be abutted against the bottom of the concave 54, while the left end is leaned against the left partition wall 13. Thus, the another product S is housed in the state of being locked by the concave 54 and the left partition wall 13 and held in a position inclined in the lower right direction. These two steps are alternately repeated to successively house the products S in the product passage 14, whereby the plurality of products S are cross housed in the product passage 14.

Figure 8B:
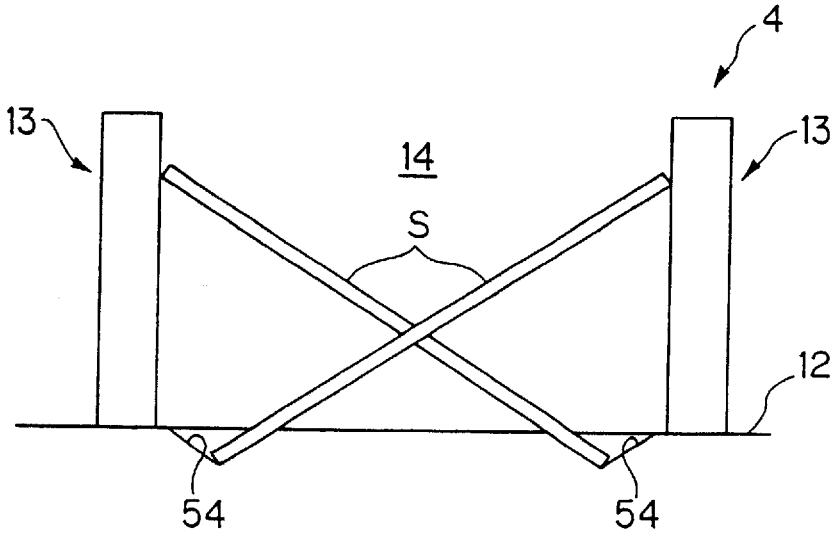

On the other hand, when a plurality of products S are housed in the product passage 14 shown in FIG. 8B, for example, one product S is first housed in such a manner that the left end is inserted into the left concave 54 so as to be abutted against the bottom of the concave 54 while the right end is leaned against the right partition wall 13. Thus, the one product S is housed in the state of being locked by the left concave 54 and the right partition wall 13 and held in a position inclined in the lower left direction. Next, another product S is abutted against the one product S on its front or rear side, and, at the same time, the right end of the another products S is inserted into the right concave 54 so as to be abutted against the bottom of the right concave 54 while the left end is leaned against the left partition wall 13. Thus, the another product S is housed in the product passage in the state of being locked by the right concave 54 and the left partition wall 13 and held in a position inclined in the lower right direction. These two steps are alternately repeated to successively house the products S in the product passage 14, whereby the plurality of products S are cross housed in the product passage 14.

Accordingly, the product housing apparatus 4 and product housing method according to this preferred embodiment also have substantially the same effect as the product housing apparatus and product housing method according to the first preferred embodiment. Further, it should be noted that, according to this preferred embodiment, although the concave 54 as the product locking section should be provided in the product rack 12, a plurality of products S can be cross housed in the product passage 14 by taking advantage of a concave having a simple structure. The size and sectional form of the concave 54 is not particularly limited, so far as products to be locked by the concave can be cross housed in the product passage 14.

Next, the product housing method according to the fifth preferred embodiment of the invention will be explained in conjunction with FIG. 9. The product housing method according to the fifth preferred embodiment, unlike the first preferred embodiment having a convex member 33 and the fourth preferred embodiment having a concave 54, a plurality of products S are housed in the product passage 14 on its product rack 12 having neither the convex member 33 nor the concave 54. Therefore, the product housing apparatus, to which the product housing method according to this preferred embodiment is applied, is different from the product housing apparatus according to the first preferred embodiment only in that the convex member 33 is not provided.

Figure 9A:
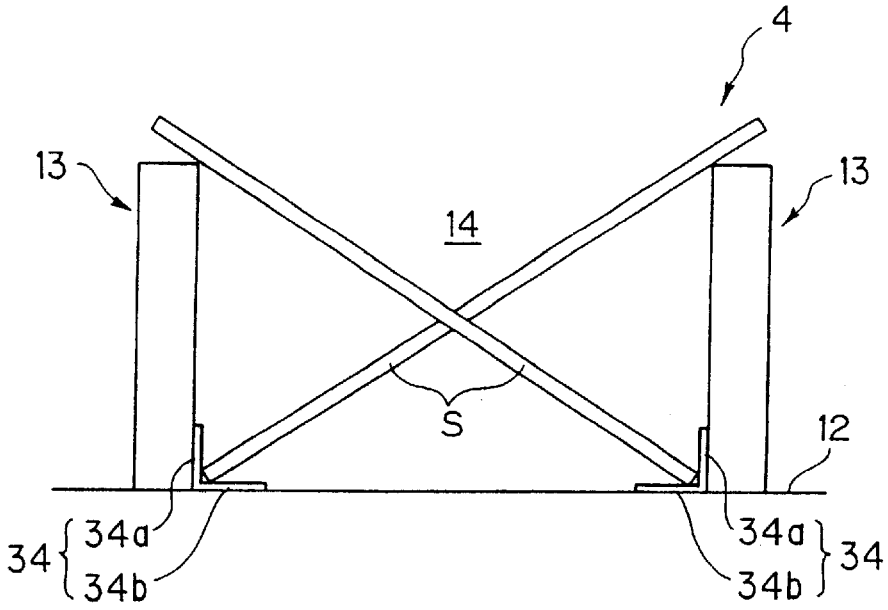
FIG. 9A is a schematic cross-sectional view showing products which have been leaned against partition walls and housed by cross housing, and FIG. 9B a schematic cross-sectional view showing products which have been leaned against partition walls and housed by identically inclined housing.

When a plurality of products S are housed in the product passage 14 by cross housing as shown in FIG. 9A, for example, one product S in its left end is first abutted against the left cover 34, while the right end is abutted and leaned against the upper end of the right partition wall 13 from its top, thereby housing the one product S in the product passage 14. Thus, the one product S is housed in the product passage 14 in the state of being locked by the left cover 34 and the right partition wall 13 and held in a position inclined in the lower left direction. Next, another product S is housed in the product passage 14 in such a state that the another product S is abutted against the one product S on its front or rear side, and, at the same time, the right end of the another product S is abutted against the right cover 34 while the left end is abutted and leaned against the upper end of the left partition wall 13 from its top. Thus, the another product S is housed in the state of being locked by the right cover 34 and the left partition wall 13 and held in a position inclined in the lower right direction. These two steps are alternatively repeated to successively house the products S to cross house the plurality of products S in the product passage 14.

Figure 9B:
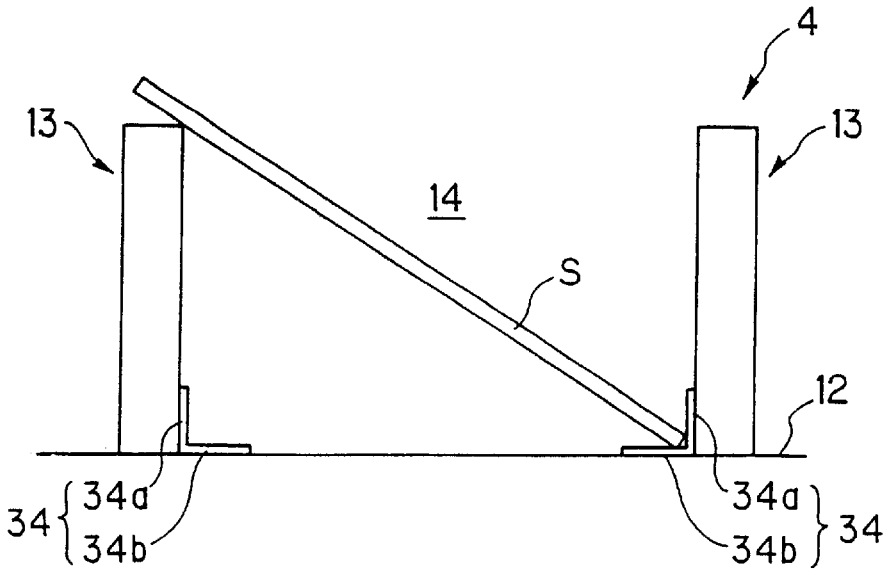

On the other hand, as shown in FIG. 9B, when a plurality of products S are housed in the product passage 14 by identically inclined housing in the lower right direction, for example, one product S is first housed in the product passage 14 in such a state that the right end of the one product S is abutted against the right cover 34 while the left end is abutted and leaned against the upper end of the left partition wall 13 from its top. Thus, the one product S is housed in the product passage 14 in the state of being locked by the right cover 34 and the left partition wall 13 and held in a position inclined in the lower right direction. Another product S is then housed in the same manner as used in the one product S in the state of being abutted against the one product S on its front or rear side. Thus, the another product S is housed in the product passage 14 in the state of being locked by the right cover 34 and the left partition wall 13 in the same manner as used in the one product S and in a position inclined at substantially the same angle as the inclination angle of the one product S. Successively housing products S in this way permits the plurality of products S to be housed in the product passage 14 by identically inclined housing in the lower right direction. In this connection, it should be noted that the plurality of products S may be housed in the product passage 14 by identically inclined housing in the lower left direction.

The product housing method according to this preferred embodiment has the following effects in addition to substantially the same effect as attained by the first preferred embodiment. Specifically, unlike the first to fourth preferred embodiments, a plurality of products S can be housed in the product passage 14 of the product rack 12 having neither the convex member 33 nor the concave 54 by cross housing or identically inclined housing. Therefore, the production of the convex member 33 and the formation of the concave 54 are unnecessary. This can realize the housing of products S at a lower cost than the housing of products by the first to fourth preferred embodiments by a cost necessary for the production of the convex member 33 and the formation of the concave 54.

In the product housing method according to this preferred embodiment, products are housed in the product passage 14 in such a state that the products are extended somewhat from the product passage 14. This poses no problem so far as the products do not come into contact with products housed in the adjacent product passage.

The invention may be carried out by various embodiments without being limited to the above preferred embodiments. The detailed construction of the convex member 33 and concave 54 and, in addition, the cover 34 described above in connection with the above preferred embodiments is illustrative only, and may be properly altered or modified within the subject matter of the invention.

As is apparent from the foregoing detailed description, the product housing apparatus and product housing method for a vending machine according to the invention is advantageous, for example, in that various products including, for example, thin products, bagged products, and wrapped products can be housed in the state of being arranged in the longitudinal direction in a product passage extended horizontally in the longitudinal direction, and, at the same time, can be properly and surely delivered at low cost.

The invention has been described in detail with particular reference to preferred embodiments, but it will be understood that variations and modifications can be effected within the scope of the invention as set forth in the appended claims.

What is claimed is:

1. A product housing apparatus for a vending machine, for housing therein a plurality of products arranged in the longitudinal direction, which at the time of selling, are pushed forwarded from behind to deliver a product, said product housing apparatus comprising:

a product passage defined by a bottom wall horizontally extended in the longitudinal direction and left and right side walls, which face each other while leaving a space therebetween in the lateral direction, extend upward from the bottom wall, and extend parallel to each other in the longitudinal direction, whereby the plurality of products being housed in the product passage are arranged in the longitudinal direction and are abutted against each other;

a product locking section provided between the left and right side walls of the bottom wall so as to extend along the product passage, the product locking section locks the plurality of products such that the products are held in a laid state and in a position inclined in the lower right direction and/or the lower left direction; and a pusher movable in the longitudinal direction through the product passage to push the plurality of products forward.

2. The product housing apparatus according to claim 1, wherein the product locking section comprises a convex which is projected upward from the bottom wall and locks the plurality of products.

3. The product housing apparatus according to claim 2, wherein the convex is disposed at a substantially center portion between the left and right side walls of the bottom wall.

4. The product housing apparatus according to claim 2, or wherein the convex is constructed so as to be detachable from the bottom wall and attachable to a plurality of positions between the left and right side walls of the bottom wall.

5. The product housing apparatus according to claim 2, wherein the surface of the convex is formed of a material having a sliding property.

6. The product housing apparatus according to claim 1, wherein the product locking section comprises a concave which is provided on the upper surface of the bottom wall and functions to lock the lower end of the plurality of products housed in the inclined position in the product passage.

7. The product housing apparatus according to claim 6, wherein the concave is provided at a substantially center portion between the left and right side walls of the bottom wall.

8. The product housing apparatus according to claim 6, wherein two concaves are provided, symmetrically with respect to the left and the right, between the left and right side walls of the bottom wall.

9. The product housing apparatus according to claim 1, wherein at least one of the left and right side walls is constructed so as to be detachable from the bottom wall and attachable to a plurality of positions in the lateral direction of the bottom wall.

10. The product housing apparatus according to claim 9, which further comprises a detachable cover which is extended in the longitudinal direction along the left and right side walls and covers, from the product passage side, a gap between the bottom wall and at least one of the left and right side walls.

11. The product housing apparatus according to claim 10, wherein the cover on its surface of the product passage side is formed of a material having a sliding property.

12. The product housing apparatus according to claim 1, which further comprises a product delivery sensor which comprises a light emitting device and a photodetector located around a delivery port of the front end of the product passage and provided so as to horizontally face each other in the lateral direction and detects the delivery of a product from the product passage based on whether or not light from the light emitting device has been received by the photodetector.

13. A product housing method for a vending machine, for housing a plurality of products which are abutted against each other and arranged in the longitudinal direction in a product passage horizontally extended in the longitudinal direction and, at the time of selling, are pushed forwarded from behind to deliver a product, wherein:

one of the plurality of products is housed, within the product passage, in a laid state and in a position inclined in one of the lower right direction and the lower left direction, the other product abutted against said one product is housed, within the product passage, in a laid state and in a position inclined in the other direction, and a pusher movable in the longitudinal direction through the product passage pushes the plurality of products forward.

14. A product housing method for a vending machine, for housing a plurality of products which are abutted against each other and arranged in the longitudinal direction in a product passage horizontally extended in the longitudinal direction and, at the time of selling, are pushed forwarded from behind to deliver a product, wherein:

the plurality of products are housed, within the product passage, in a laid state and in a position inclined at substantially the same angle in one of the lower right direction and the lower left direction, and a pusher movable in the longitudinal direction through the product passage pushes the plurality of products forward.

* * * * *